US007617889B2

(12) United States Patent
Beccu

(10) Patent No.: US 7,617,889 B2
(45) **Date of Patent: *Nov. 17, 2009**

(54) BACKHEAD AND DRILL ASSEMBLY WITH BACKHEAD

(75) Inventor: Rainer S. Beccu, Houston, TX (US)

(73) Assignee: Rockmore International, Inc., Wilsonville, OR (US)

( * ) Notice: Subject to any disclaimer, the term of this patent is extended or adjusted under 35 U.S.C. 154(b) by 155 days.

This patent is subject to a terminal disclaimer.

(21) Appl. No.: 11/817,292

(22) PCT Filed: Oct. 31, 2006

(86) PCT No.: PCT/US2006/042740

§ 371 (c)(1),
(2), (4) Date: Aug. 28, 2007

(87) PCT Pub. No.: WO2007/056035

PCT Pub. Date: May 18, 2007

(65) Prior Publication Data

US 2008/0156540 A1 Jul. 3, 2008

Related U.S. Application Data

(60) Provisional application No. 60/733,860, filed on Nov. 3, 2005.

(51) Int. Cl.
*E21B 4/14* (2006.01)

(52) U.S. Cl. ..... 175/296; 175/293; 173/90

(58) Field of Classification Search ..... 175/293, 175/296; 173/90

See application file for complete search history.

(56) References Cited

U.S. PATENT DOCUMENTS 3,704,756 A * 12/1972 Wolda ..... 175/246
4,248,133 A 2/1981 Petukhov et al.
4,819,739 A * 4/1989 Fuller ..... 173/17

(Continued)

FOREIGN PATENT DOCUMENTS

CA 1 178 861 12/1984

(Continued)

OTHER PUBLICATIONS

International Search Report and Written Opinion for PCT/US06/42740, filed Oct. 31, 2006 (mailed Feb. 26, 2007).

(Continued)

*Primary Examiner*—Shane Bomar
(74) *Attorney, Agent, or Firm*—Klarquist Sparkman, LLP

(57) ABSTRACT

In representative embodiments, a backhead for a drill assembly comprises an elongate member having a proximal end connectible to a source of pressurized fluid, a side wall defining an axial bore and an open distal end. A portion of the bore extending proximally from the distal end has an inner surface defining a cylinder portion shaped to receive an axially movable piston. The axial bore also comprises a check valve receiving area shaped to receive a check valve and to separate, during normal operation when a check valve is received in the check valve receiving area, an inlet area extending proximally to the proximal end from the cylinder portion extending distally to the distal end. Various improvements in retaining the distributor and increasing flow efficiency are described.

11 Claims, 13 Drawing Sheets

U.S. PATENT DOCUMENTS

| | | | | |
|---|---|---|---|---|
| 4,819,746 | A | 4/1989 | Brown et al. | |
| 4,878,550 | A | 11/1989 | Chuang | |
| 4,923,018 | A | 5/1990 | Meek | |
| 5,301,761 | A | 4/1994 | Fu et al. | |
| 5,511,628 | A | 4/1996 | Holte | |
| 5,682,957 | A | 11/1997 | Lyon | |
| 5,685,380 | A | 11/1997 | Purcell et al. | |
| 6,062,322 | A | 5/2000 | Beccu et al. | |
| 6,290,424 | B1 | 9/2001 | Purcell | |
| 6,454,026 | B1 * | 9/2002 | Shofner | 175/296 |
| 6,502,650 | B1 * | 1/2003 | Beccu | 175/296 |
| 6,588,516 | B2 | 7/2003 | Runquist et al. | |
| 6,799,641 | B1 | 10/2004 | Lyon et al. | |
| 2004/0206550 | A1 | 10/2004 | Gien | |
| 2005/0034899 | A1 | 2/2005 | Lyon | |

FOREIGN PATENT DOCUMENTS

| | | |
|---|---|---|
| GB | 2 296 731 | 7/1996 |
| RU | 2 090 730 | 9/1997 |
| WO | WO 01/71150 | 9/2001 |
| WO | WO 01/83931 | 11/2001 |
| WO | WO 2004/031530 | 4/2004 |

OTHER PUBLICATIONS

International Drill Quip, "Millennium Hammers & Casing Tube System Bits," 2 pages (document not dated).
International Drill Quip, "DTH Conventional Hammers," 10 pages (document not dated).

* cited by examiner

BACKHEAD AND DRILL ASSEMBLY WITH BACKHEAD

CROSS REFERENCE TO RELATED APPLICATION

This is the U.S. National Stage of International Application No. PCT/US2006/042740, filed Oct. 31, 2006, which was published in English under PCT Article 21(2), which in turn claims the benefit of U.S. Provisional Application No. 60/733,860, filed Nov. 3, 2005. Both applications are incorporated herein in their entirety.

FIELD

This application relates to drilling equipment, and in particular to an improved construction of a fluid-operated drilling tool.

BACKGROUND

Known types of fluid-operated drilling tools, particularly "down-the-hole" rock drilling tools, generally have one end connected to a source of pressurized fluid (referred to here as the proximal end) and an opposite distal or working end with a reciprocating bit that is controlled to strike material to be drilled or removed with high force.

In a conventional rock drilling tool, the source of pressurized fluid, which is typically compressed air or other gas, is connected to a backhead or top sub at the proximal end of the tool by a pressure fitting. A hollow wear sleeve is attached by a threaded connection to the backhead and extends distally to form the exterior surface or shank of the tool. Within the wear sleeve, there is a distributor with a check valve that selectively supplies pressurized fluid to move the piston.

Typically, the distributor is secured in place by its attachment to an interior surface of the wear sleeve. According to one known approach, the distributor is received within the bore of an inner cylinder, and the inner cylinder has a surrounding retaining ring that is received in a circumferential groove formed in the interior surface of the wear sleeve. Over time, it becomes necessary to remove the distributor, e.g., to repair or replace it, to replace the wear sleeve to which it is attached and/or to access other components within the wear sleeve, e.g., the piston. In conventional drilling tools, uncoupling the distributor from the wear sleeve is difficult. For example, it can be difficult to access the retaining ring and disengage it from the wear sleeve and/or the distributor.

In conventional drilling tools, some of the passageways for the pressurized fluid have reduced areas and/or other types of restrictions that decrease flow velocity and efficiency. Some of the passageways extend between coaxially positioned components, and some are formed at least in part by channels, grooves, openings, etc., formed in walls of the components.

In the operation of some drilling tools, such as a down-the-hole rock drilling tool, the tool is designed such that when the bit encounters a very low resistance during operation, such as when the bit encounters a void in the material being drilled, the bit is extended to a "drop open" position and further movement of the bits is stopped. In the way, the possibility for damage to the tool or to the operation is minimized. It would be advantageous to decrease the transition time for changing from a normal operating position to the drop open position.

In addition, the speed at which the tool transitions between other phases of operation is affected by the piston area. It would be advantageous to reduce the transition times between other phases of operation to improve overall efficiency.

SUMMARY

Described herein are embodiments of a backhead and drill assembly with a backhead that address some of the problems associated with current drilling tools.

According to one implementation, a portion of a drill assembly operated by a supply of compressed fluid comprises a backhead with an integrated piston, a hollow elongate wear sleeve and a piston. The backhead has a proximal end connectible to the supply, an axial bore and an open distal end having the integrated cylinder portion defined therein. The backhead has passages extending between the axial bore and outer surface of the backhead. The hollow elongate wear sleeve has a proximal end to which the backhead is coupled and into which the distal end of the backhead is received. The piston is housed by the wear sleeve and has a proximal end shaped to fit within the integrated cylinder portion of the backhead. The piston is slidably movable along the wear sleeve and the integrated cylinder portion in response to compressed fluid conveyed through the backhead. An intake flow path for an intake flow of compressed fluid in the drilling tool extends in a distal direction from the axial bore, through the passages in the backhead, through a space between the backhead and the wear sleeve and into an area between the piston and wear sleeve and into contact with the piston. Advantageously, the intake flow path is free from sharp bends.

The intake flow path may be configured so as not to extend through any apertures forcing the intake flow in a radially inward direction. The intake flow path may be configured so as not to require the intake flow to pass inwardly through any openings defined in a sidewall of the backhead.

The drill assembly may comprise a distributor positioned at least partially within the axial bore between the proximal end and the distal end, the distributor being removably secured to the backhead by a securing member accessible from an exterior surface of the backhead and including a check valve that is opened to allow the intake flow from the supply. The distributor can comprise a check valve having a sealing member, a biasing member that biases the sealing member to a closed position and a distally extending guide portion. The drill assembly may comprise a chuck coupled to a distal end of the wear sleeve and capable of receiving a drill bit and being movable in response to contact from the piston.

According to other embodiments, a portion of a drill assembly operated by a supply of compressed fluid comprises a backhead having a proximal end connectible to the supply, an axial bore and an open distal end having defined therein an integrated cylinder portion shaped to receive a piston member, and a distributor positioned at least partially within the axial bore between the proximal end and the distal end, the distributor being removably secured to the backhead by a securing member accessible from an exterior surface of the backhead.

The securing member can comprise a laterally extending pin inserted through at least one opening in the backhead. The securing member can comprise at least two laterally extending pins, each of the pins being inserted through one of a corresponding number of spaced-apart openings in the backhead.

The backhead can include an externally threaded portion to which a wear sleeve can be attached, and the securing member can comprise a laterally extending pin inserted through at least one opening in the backhead in the area of the threaded portion.

According to other embodiments, a portion of a drill assembly operated by a supply of compressed fluid comprises a backhead having a proximal end connectible to the supply, an axial bore and an open distal end having defined therein an integrated cylinder portion, the backhead having passages extending between the axial bore and outer surface of the backhead, a hollow elongate wear sleeve having a proximal end to which the backhead is coupled and into which the distal end of the backhead is received, and a piston housed by the wear sleeve and having a proximal end shaped to fit within the integrated cylinder portion of the backhead, the piston being slidably movable along the wear sleeve and the integrated cylinder portion in response to compressed fluid conveyed through the backhead. When the drill assembly is in a drop open position, a proximal end of the piston is spaced apart from the integrated cylinder portion in the distal direction and an open annular space is defined between a proximal end of the piston and the wear sleeve.

The piston can have an available piston area subject to pressure tending to move the piston in a distal direction that is about 5% to about 25% greater than the available piston area of a conventional drill assembly of the same outer diameter. In other embodiments, the piston can have an available piston area that is about 8% to about 10% greater than the available piston area of a conventional drill assembly of the same outer diameter. In still other embodiments, the piston can have an available piston area that is at least about 9% greater than the available piston area of a conventional drill assembly of the same outer diameter.

According to other embodiments, a portion of a drill assembly operated by a supply of compressed fluid comprises a backhead having a proximal end connectible to the supply, an axial bore and an open distal end having defined therein an integrated cylinder portion, the backhead having passages extending between the axial bore and outer surface of the backhead, a cylinder portion aligned with and in selective fluid communication with the backhead, a hollow elongate wear sleeve surrounding the cylinder portion and connected to the backhead, a piston housed by the wear sleeve and having a proximal end shaped to fit within the cylinder portion, the piston being slidably movable along the wear sleeve and the cylinder portion in response to compressed fluid conveyed through the backhead. When the drill assembly is in a drop open position, a proximal end of the piston is spaced apart from the cylinder portion and the wear sleeve.

According to other embodiments, a portion of a drill assembly operated by a supply of compressed fluid comprises a backhead having a proximal end connectible to the supply, an axial bore and an open distal end having defined therein an integrated cylinder portion, the backhead having passages extending between the axial bore and outer surface of the backhead, a hollow elongate wear sleeve having a proximal end to which the backhead is coupled and into which the distal end of the backhead is received, and a piston housed by the wear sleeve and having a proximal end shaped to fit within the integrated cylinder portion of the backhead, the piston being slidably movable along the wear sleeve and the integrated cylinder portion in response to compressed fluid conveyed through the backhead. An intake flow path for an intake flow of compressed fluid in the drilling tool extends in a distal direction from the axial bore, through the passages in the backhead, through a space between the backhead and the wear sleeve and into an area between the piston and wear sleeve and into contact with the piston, and a filling flow path extends in the proximal direction from the area between the piston and the wear sleeve, along the piston and between the piston and the backhead into a space proximal of the proximal end of the piston. Advantageously, a separation is maintained between the intake flow path and the filling flow path in the area between the piston and the wear sleeve.

The distal end of the backhead can have a circumferential wall configured to guide the filling flow flowing in the proximal direction along an inner surface of the wall and configured to guide the intake flow flowing in the distal direction along an outer surface of the wall, the intake flow and the filling flow being separated from each other by the wall.

The foregoing and other features and advantages will become more apparent from the following detailed description, which proceeds with reference to the accompanying figures.

DETAILED DESCRIPTION

Figure 1:
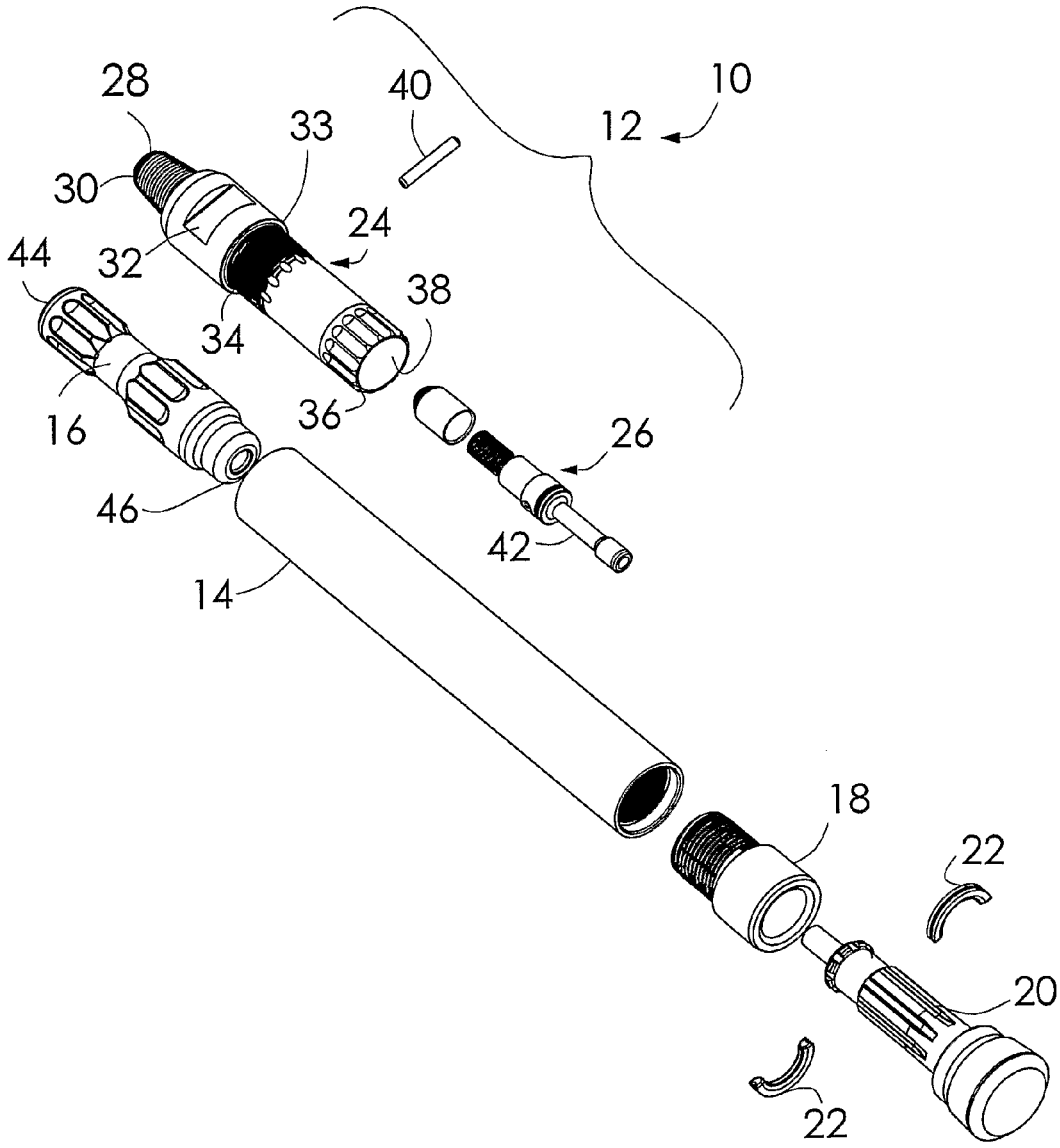
FIG. 1 is an exploded perspective view of a fluid-operated drilling tool showing a new backhead, a distributor, a piston, a wear sleeve, a chuck, and a bit and bit retaining rings.

FIG. 1 is an exploded perspective view showing an embodiment of a fluid-operated drilling tool 10. The major components of the drilling tool 10 are a backhead and distributor assembly 12 at a proximal end of the tool, a wear sleeve 14, an axially movable piston 16, and at the distal or working end of the tool, a chuck 18, a bit 20 and bit retaining rings 22. In operation, pressurized fluid supplied to the backhead and distributor assembly 12 is used to selectively drive the piston 16 to reciprocatingly translate and to strike the bit 20, thus causing the bit to exert an impact force on any adjacent material to be drilled.

The backhead assembly 12 includes a backhead 24 and a distributor or check valve assembly 26. The backhead 24 is an elongate member having an exposed proximal end 28 with a connection 30 for attachment to a source of pressurized fluid. The backhead 24 also has a tool receiving portion 32 shaped to receive a tool, e.g., a wrench, to assist in installing and removing the backhead. Adjacent the tool receiving portion 32 is a threaded portion 34. In the illustrated embodiment, an outer diameter of the backhead is stepped down at a shoulder 33 immediately adjacent the threaded portion 34.

The backhead 24 has an open distal end 36 defining one end of an axial bore 38. The distributor 26 is fit within the bore 38 and is coupled to the backhead 24, e.g., by a securing member accessible from an exterior of the backhead, such as a pin 40, as described below in more detail. The distributor has an elongated guide 42 that extends distally.

The piston 16 has a proximal end 44 slidably received in the bore 38 and a distal end 46 slidably received within the wear sleeve 14. The wear sleeve 14 is removably connected at its proximal end to the backhead and distributor assembly 12, such as by the threaded portion 34. The wear sleeve 14 extends distally in the drilling direction, and the chuck 18 is attached at its distal end. The chuck 18 receives the bit 20, which can be held in place by the bit retaining rings 22.

Figure 2:
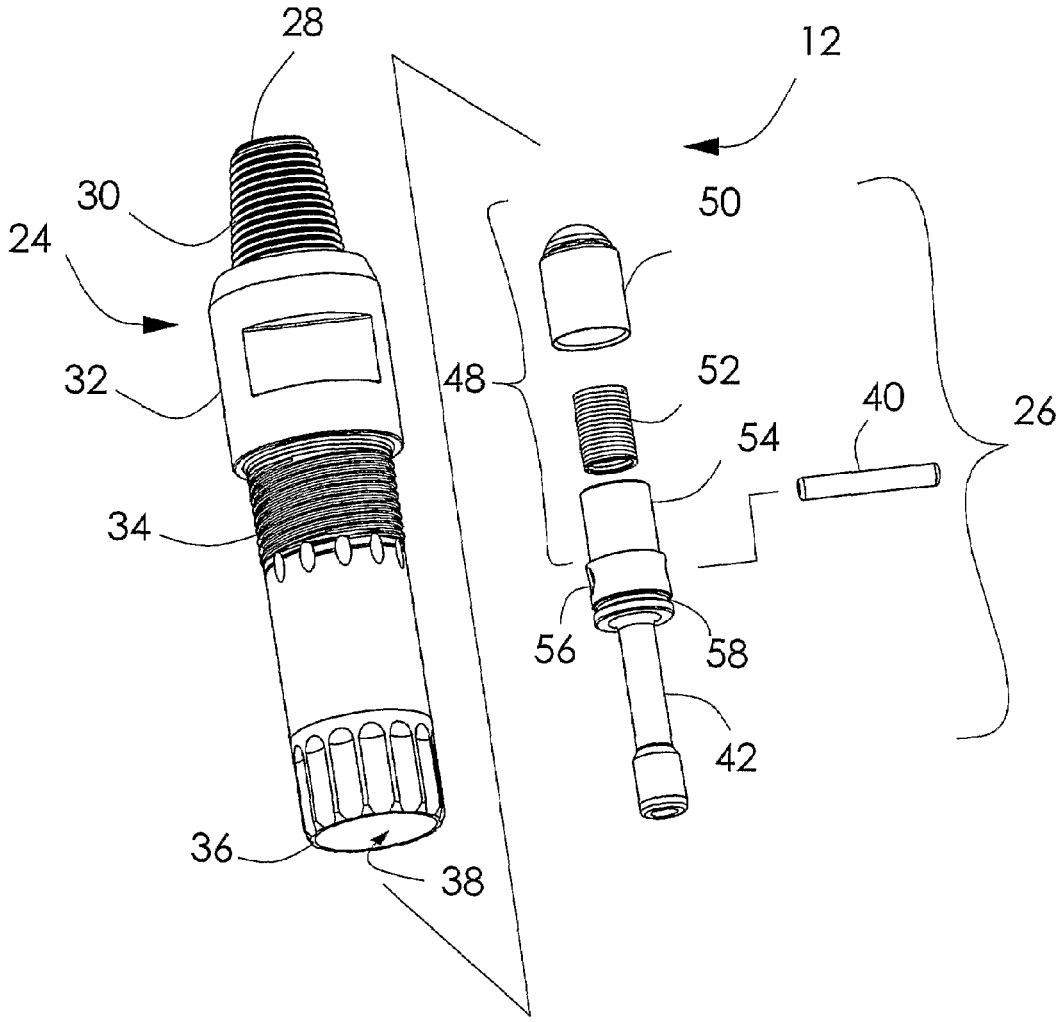
FIG. 2 is an enlarged exploded perspective view of the backhead and distributor assembly of FIG. 1.

Referring to FIG. 2, the distributor 26 has a check valve 48 with a cap-shaped sealing member 50, a biasing member 52 and stationary member 54 from which the elongated guide 42 extends. The stationary member 54 has a transverse bore 56 sized to receive the pin 40 and a circumferential groove 58 for a seal.

Figure 3:
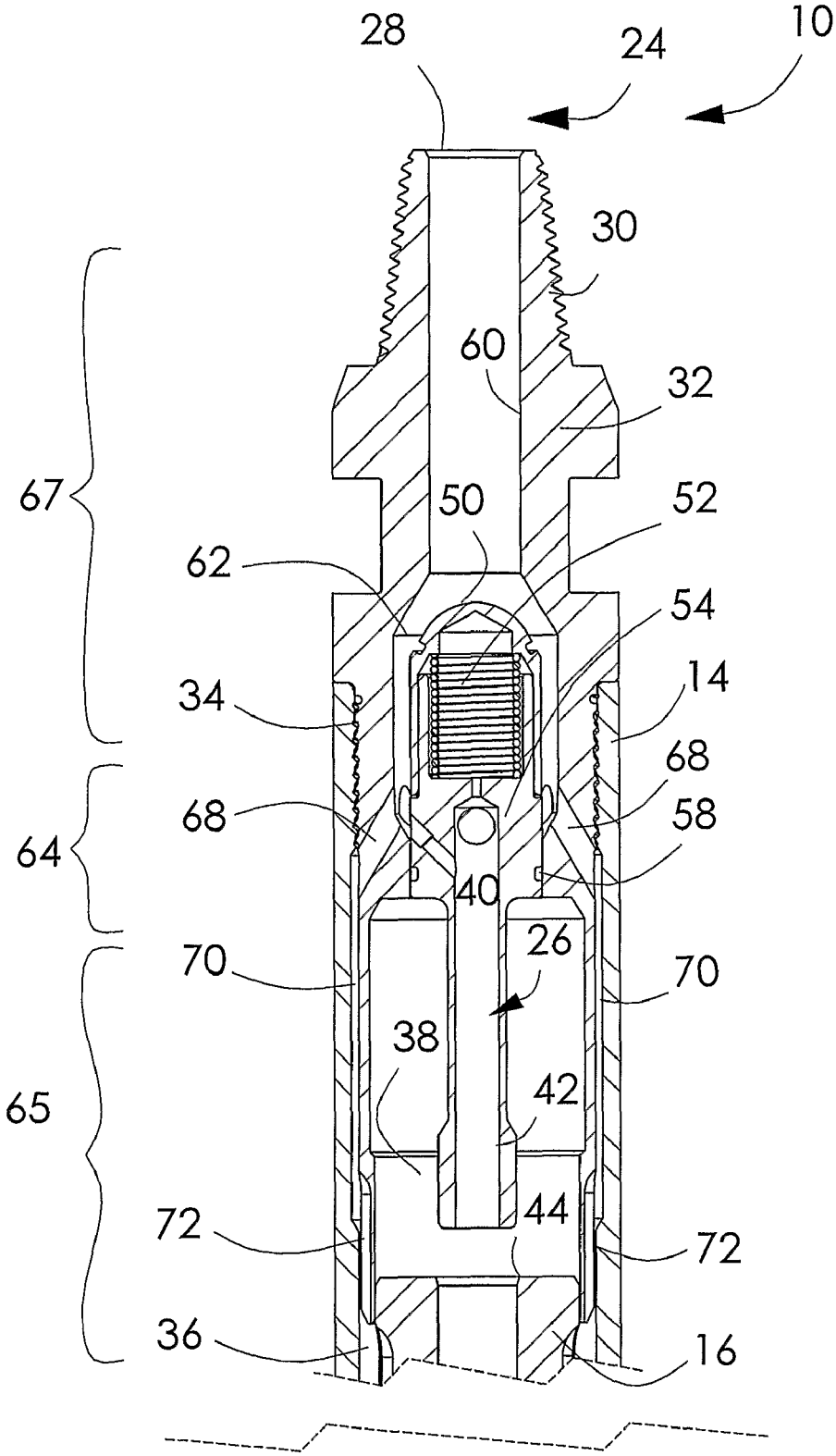
FIG. 3 is a sectioned view, in elevation, of the backhead and distributor assembly attached to the wear sleeve and showing a portion of the piston within an inner end of the backhead.

Referring to FIG. 3, the axial bore 38 has an inlet bore segment 60 extending from the proximal end 28 of the backhead 24 that widens into a chamber 62. At its distal end, the chamber 62 narrows slightly into a necked-down portion defining a check valve receiving area 64 that receives the stationary member 54 of the distributor 26 as shown. At the distal end of the check valve receiving area 64, the bore 38 is widest and the inner surface thereof defines a cylinder portion 65 within which the proximal end of the piston 16 is slidably received. The stationary member 54 and a seal in the groove 58 seal off the chamber 62 from the bore 38 when the valve is in normal operation. Thus, the check valve receiving area 64 separates the cylinder portion 65 from an inlet area 67 extending proximally of the check valve receiving area 64.

Figure 4:
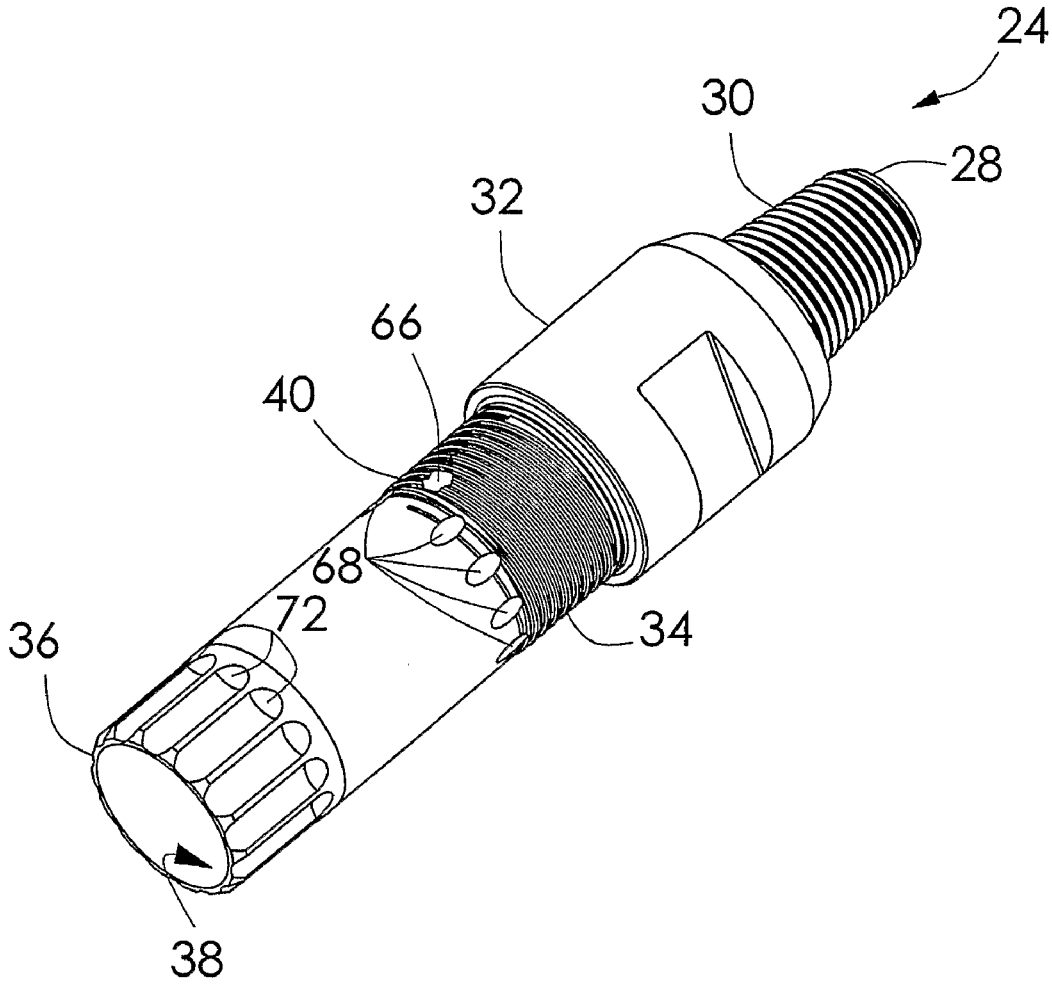
FIG. 4 is a perspective view of the backhead and distributor assembly of FIG. 1.

The backhead 24 has at least one through passage 68 which connects the chamber 60 with an axially extending annular space 70 in the wear tube 14. In a representative embodiment as shown in FIGS. 3 and 4, there are multiple circumferentially-spaced fluid through passages 68. Adjacent the distal end 36, the backhead 24 has circumferentially spaced external grooves 72 that also serve as flow passages between the backhead and the surrounding wear sleeve 14. As best shown in FIG. 3, the backhead 24 and wear sleeve 14 can be shaped such that the backhead has a close fit with the wear sleeve adjacent the distal end 36, and is spaced from the wear sleeve along at least a segment of its length in the area of the annular space 70.

In one embodiment, as best shown in FIG. 4, the securing member is the pin 40 and the backhead 24 has a transverse opening 66 sized to receive the pin 40. In the FIG. 4 embodiment, unthreading the backhead 24 exposes the pin 40 and thus allows the distributor 26 to be removed from the backhead 24. Of course, it is also possible to use a securing member of a type other than a pin.

Figure 6:
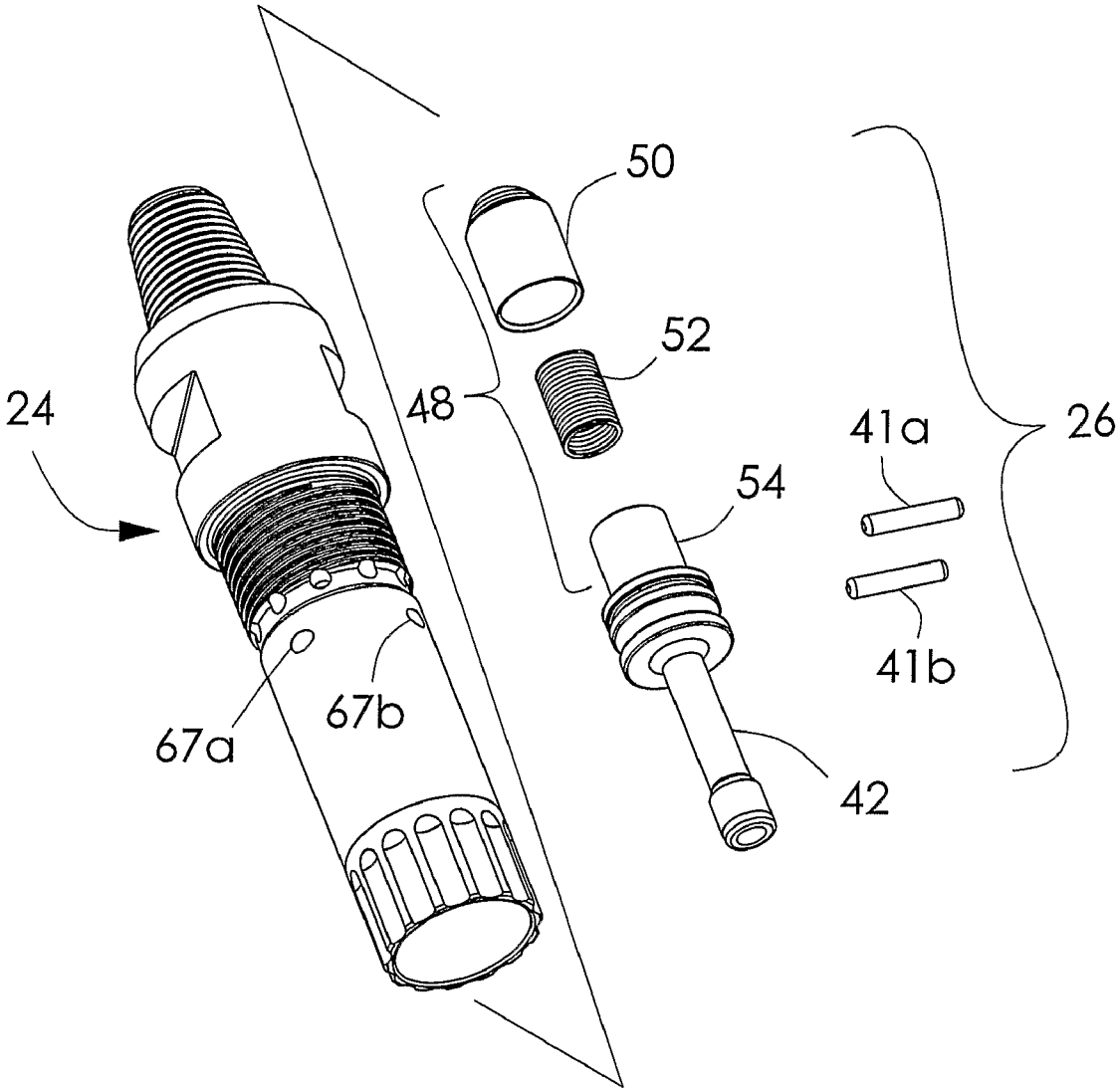
FIG. 6 is a perspective view of the backhead and distributor assembly similar to FIG. 2, except showing a securing member in the form of two pins.
Figure 7:
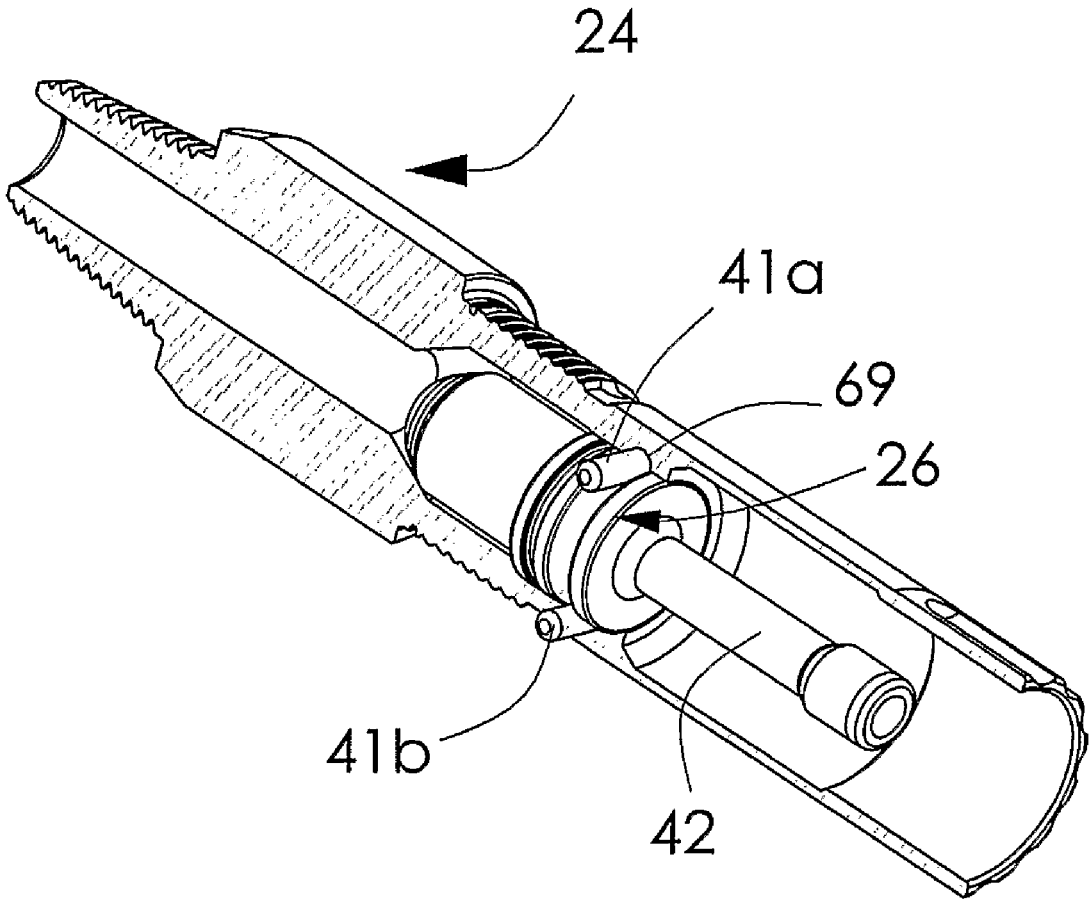
FIG. 7 is a sectioned view of the backhead and distributor assembly of FIG. 6 as assembled showing the positions of the two pins.

In another embodiment, as best shown in FIG. 6, the securing member is a pair of pins 41*a* and 41*b*, each of which can be inserted into a respective one of the openings 67*a*, 67*b* in the backhead and distributor to removably secure the distributor in place relative to the backhead. The openings 67*a*, 67*b* are parallel and spaced from each other, extending in a direction transverse to the backhead. As best shown in FIG. 7, the pins 41*a*, 41*b* engage opposite sides of a groove 69 formed in the backhead. Of course, it would be possible to use additional pins or elements, and/or to use elements extending only partially through the backhead.

Figure 5A:
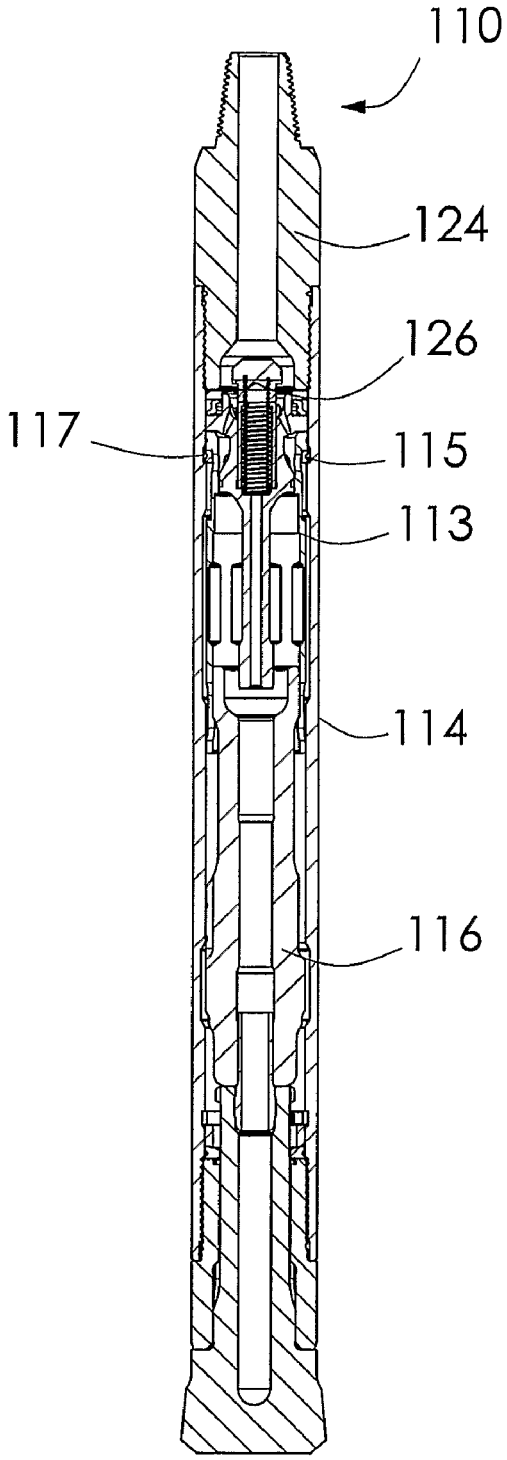
FIG. 5A PRIOR ART
FIGS. 5A and 5B are sectioned views, in elevation, of a conventional fluid-operated drilling tool and a similar tool with the new backhead of FIG. 1, respectively.

FIG. 5A shows a conventional fluid-operated drilling tool 110 having a backhead 124, an inner cylinder component 113 separate from the backhead 124 and a distributor (or check valve assembly) 126 coupled to the wear sleeve 114. The backhead 124 is collected to the wear sleeve 114 by a threaded connection. Because the inner cylinder component 113 is also a separate component, it must also be coupled to the wear sleeve 114. As shown in FIG. 5A, the inner cylinder component 113 is coupled to the wear sleeve 114 by retaining members 115 that expand to fit within a circumferential groove 117 formed in the wear sleeve at a position spaced from its proximal end.

With the conventional tool 110, removing the distributor 126 can be very difficult. The distributor 126 might need to be removed in order to repair or service it, to use it in a new wear sleeve 114, to replace or service the piston 116, etc. To remove the distributor 126, the backhead 124 is unscrewed from the wear sleeve 114. A tool is then inserted into the wear sleeve 114 in an effort to contact the retaining members 115 and disengage them from the groove 117. This operation is often very difficult to execute, especially in conditions encountered in the field. With small versions of the tool 110, a user can sometimes succeed in disengaging the distributor 126 by inverting the wear sleeve 114 and hitting its proximal end against a hard surface. With larger versions of the tool 110, it is not possible to maneuver the wear sleeve in this way.

Figure 5B:
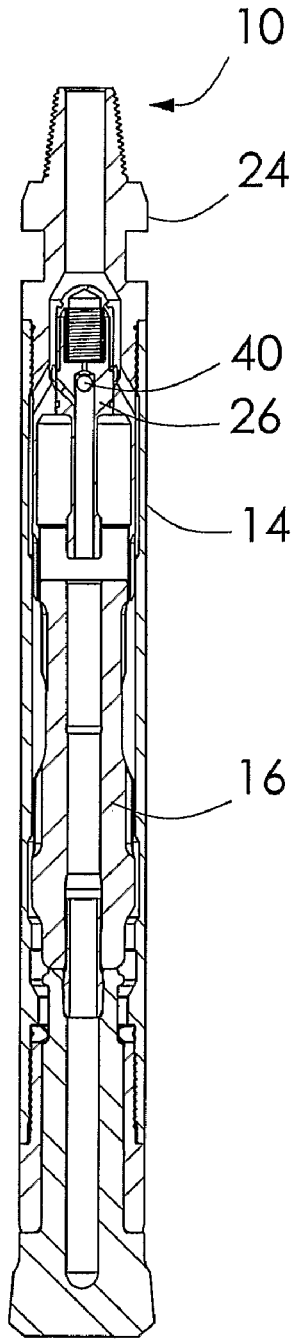

By comparison, the tool 10 with the new backhead and integrated cylinder as shown in FIG. 5B allows comparatively easy disassembly. The backhead assembly 12 is unscrewed from the wear sleeve 14, and the distributor 26 can be removed from the backhead 24 by removing the securing member, e.g., removing the pin 40. With the backhead assembly 12 unscrewed from the wear sleeve 14, the piston 16 is easily accessible and can be slid out of the wear sleeve 14.

The wear sleeve 14 does not require any complicated machining to form a groove or other undercut retaining feature similar to the groove 117, and thus is simpler and cheaper to produce. Without these features, the walls of the wear sleeve can be made thinner. Stated differently, for a given external diameter, such as for the 4-inch tools 10 and 110, the wear sleeve 14 can accommodate a piston 16 having an area at least about 5% greater than the piston 116, as is described below in greater detail.

The new backhead assembly 12 with the integrated distributor 26 conserves operating length in the axial direction. Thus, the tool 10 can have a shorter length than the conventional tool 110 with the same or comparable operating capabilities. As a result, the tool 10 can save costs and is easier to handle.

In the following description, a comparison of the flow passageways and piston areas between the conventional drilling tool 110 and the drilling tool 10 is described.

Figure 8A:
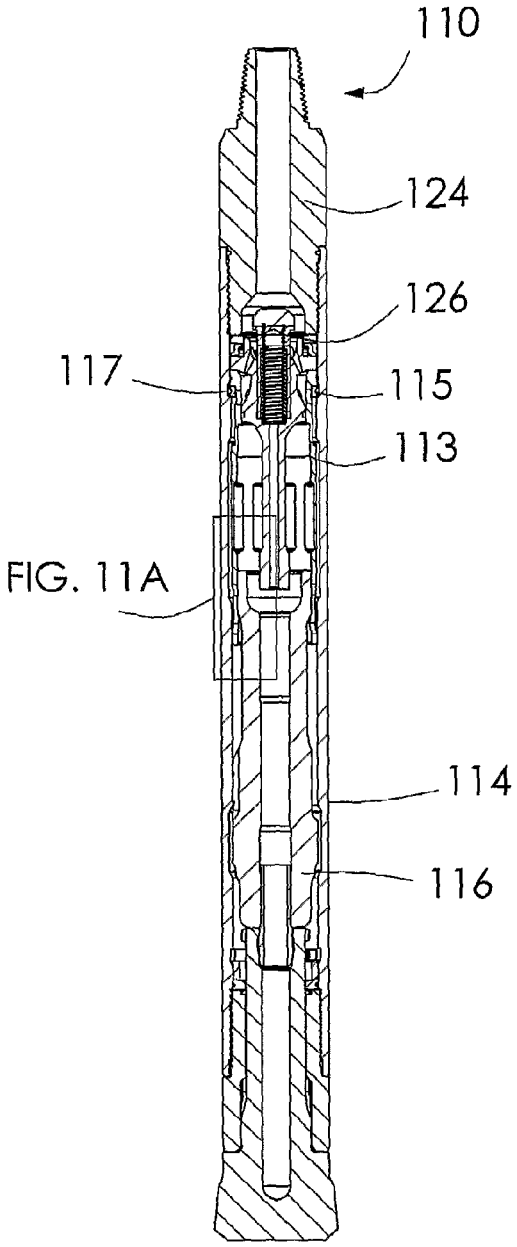
FIG. 8A PRIOR ART
FIG. 8A and FIG. 8B are sectioned views, in elevation, of a conventional fluid-operated drilling tool and a new drilling tool according to this application, respectively, showing the pistons in an impact position.
Figure 8B:
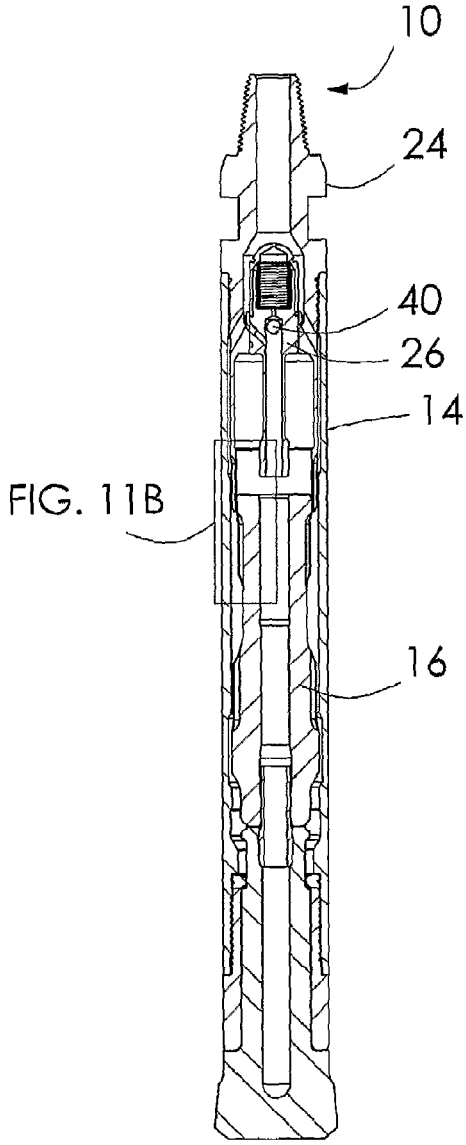
Figure 9A:
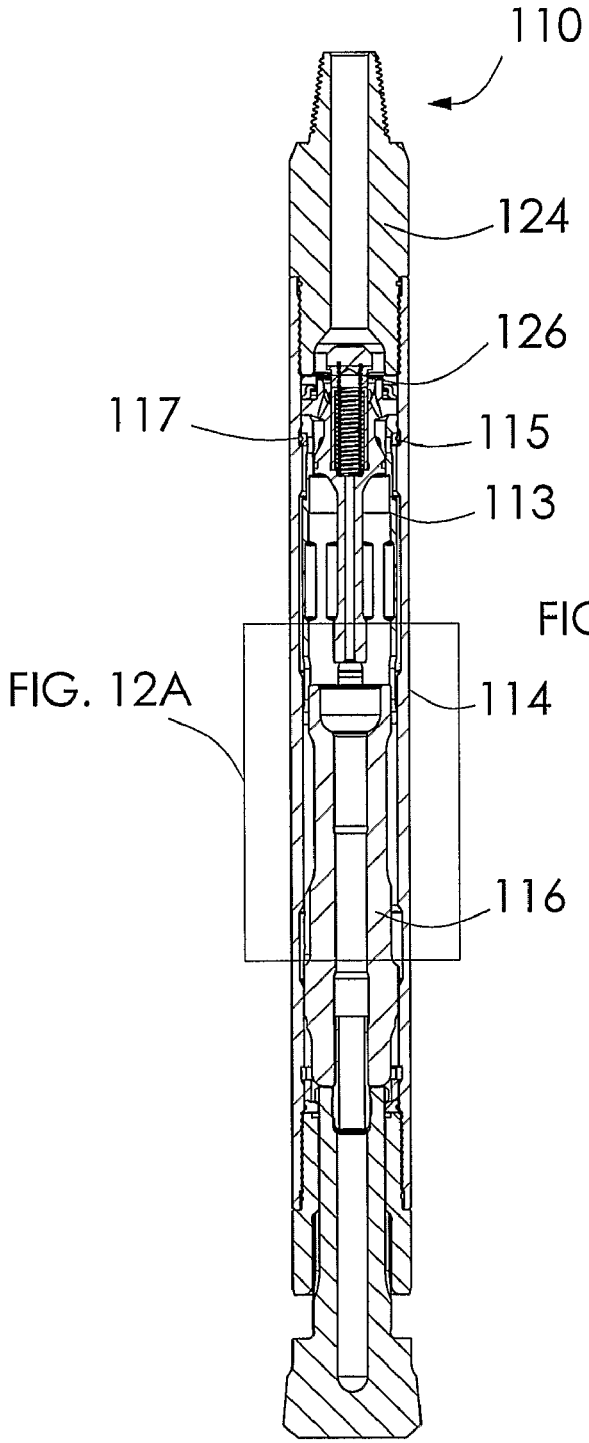
FIG. 9A PRIOR ART
FIG. 9A and FIG. 9B are sectioned views similar to FIG. 8A and FIG. 8B, respectively, except showing the tools in a drop open position.
Figure 9B:
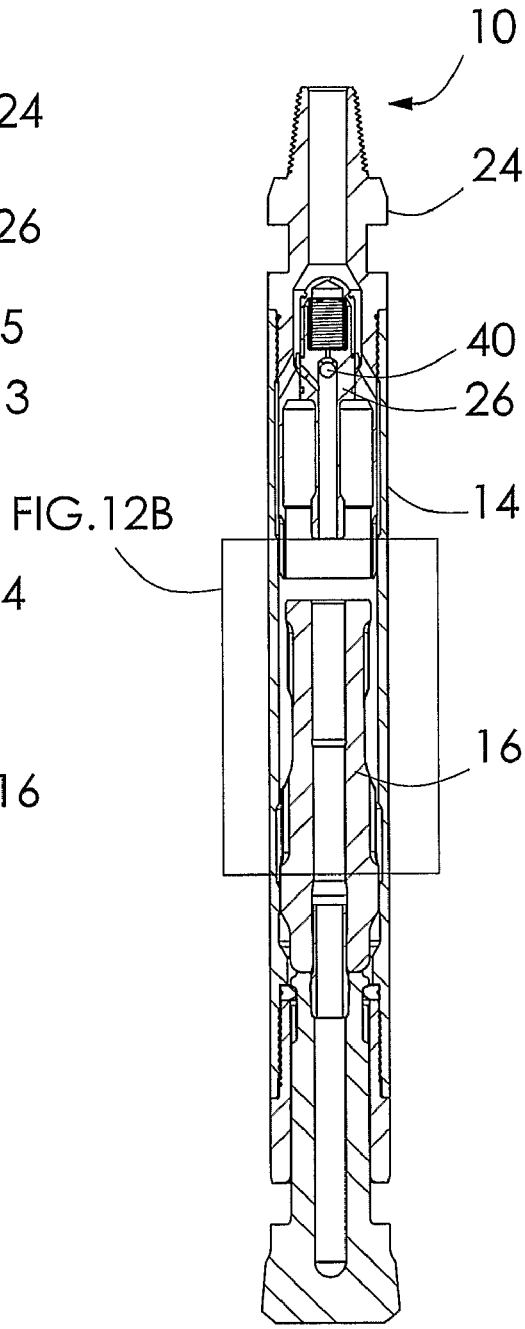
Figure 10A:
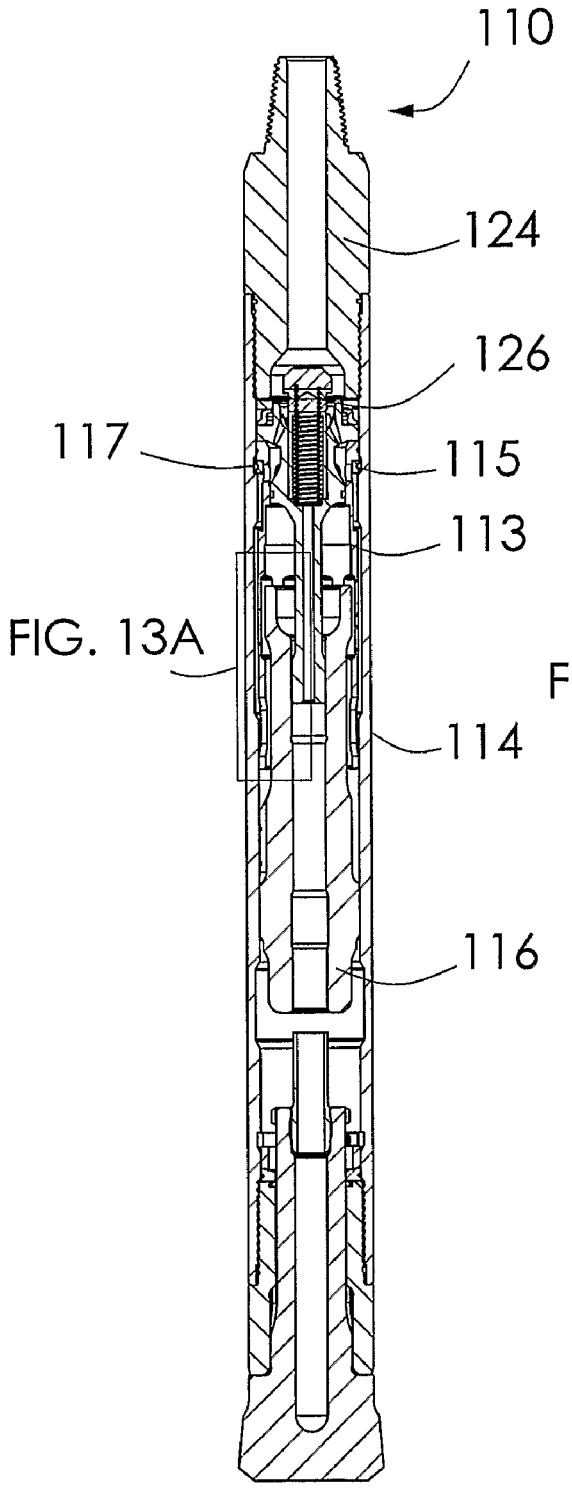
FIG. 10A PRIOR ART
FIGS. 10A and 10B are sectioned views similar to FIG. 8A and FIG. 8B, respectively except showing the tools with the pistons in a top position.
Figure 10B:
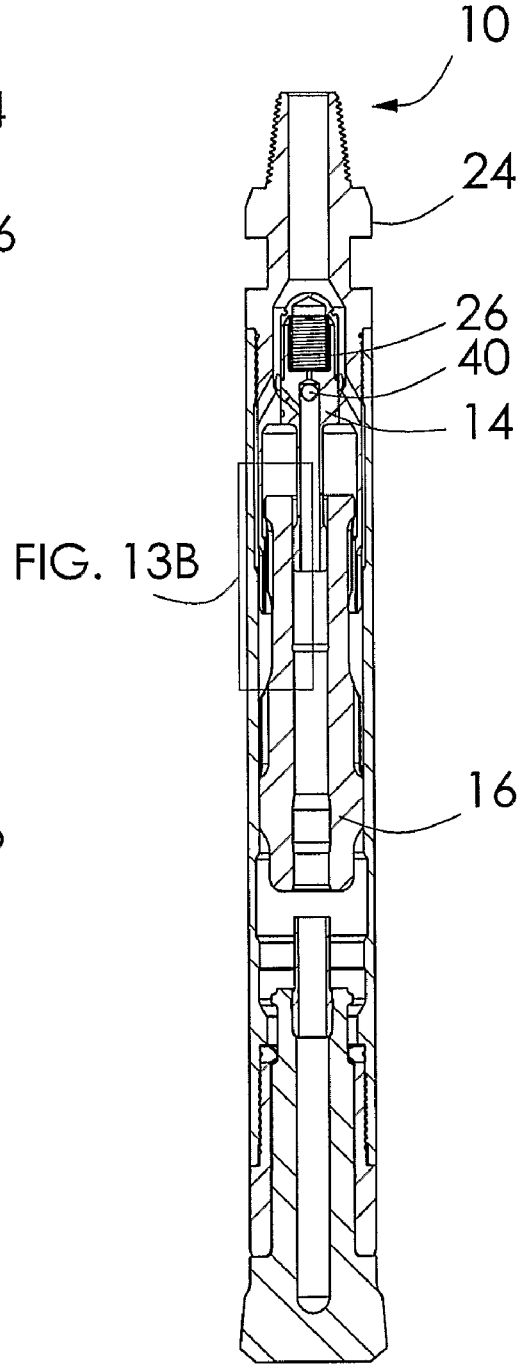

FIG. 8A and FIG. 8B are section views in elevation showing the conventional drilling tool and a drilling tool according to an embodiment of this application, respectively, in the impact position, i.e., when the piston has contacted the bit, which in turn exerts an impact on any material with which the bit is in contact. FIGS. 9A and 9B are similar to FIGS. 8A and 8B, but shown the respective drilling tools in a drop open position, when the tools have been brought to rest, such as, e.g., if a void is encountered while drilling. FIGS. 10A and 10B are similar to FIGS. 8A and 8B, but show the respective drilling tools in a position when the piston is at the top of its stroke, i.e., withdrawn in the distal direction.

Figure 11A:
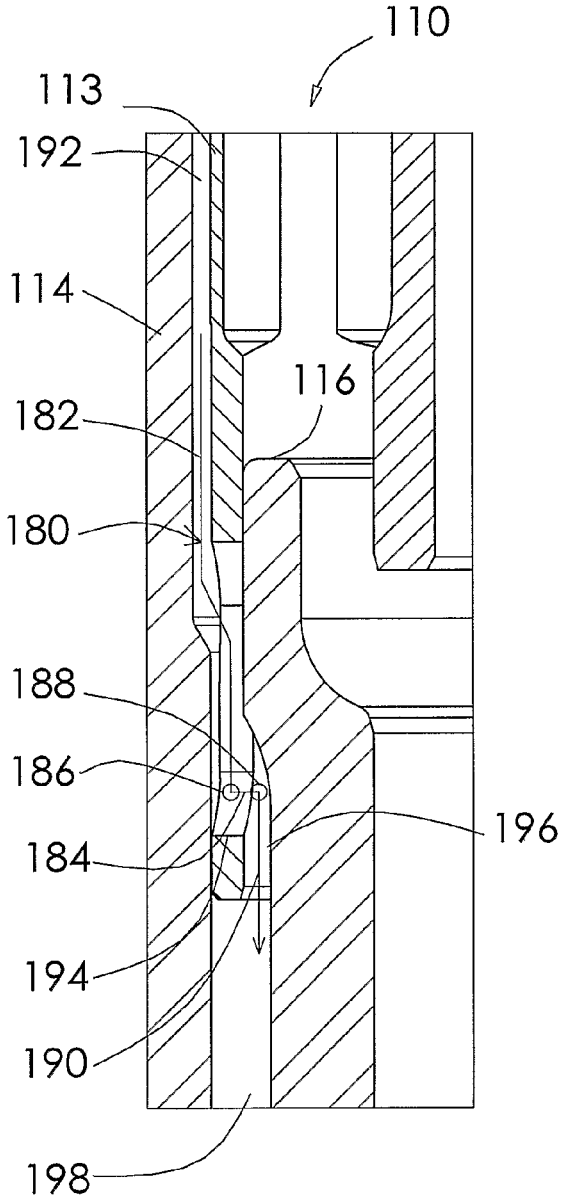
FIG. 11A PRIOR ART
FIG. 11A and FIG. 11B are enlarged views of portions of FIG. 8A and FIG. 8B, respectively.

FIG. 11A is an enlarged section view of a portion of the conventional drilling tool 110 shown in FIG. 8A (i.e., in the impact position). As seen in FIG. 11A, the intake of compressed operating fluid, which occurs at one or more times during a complete operating cycle, forces the fluid to follow a flow path 180 through two substantial changes in direction. As a result, the flow's velocity is decreased and thus the time required to complete the intake is lengthened. Specifically, the intake flow path 180 has an upper segment 182 beginning in the passageway 192 between the wear sleeve 114 and the inner cylinder component 113. Where the flow leaves the passageway 192, the flow path 180 turns abruptly inward at a first sharp bend 186 and continues through the aperture 194 formed in a wall of the inner cylinder 113 along an intermediate segment 184. After traveling through the aperture 194, the flow encounters the solid wall of the piston 116, so it makes another abrupt turn at a second sharp bend 188. The flow path 180 then continues in a downward direction along a lower segment 190 in the direction of the arrow, which travels through an inner passageway 196 formed between an inner side of the inner cylinder 113 and the outer wall of the piston 116, before leading into a region 198 between the piston 116 and the wear sleeve 114.

As shown in the drawing, the intake flow must travel through two substantial bends, each of which is approximately 90 degrees along the mean flow path. As a result, velocity decreases substantially and momentum and energy are lost. Although only a single intake flow path 180 is represented for the portion of the conventional drilling tool 110 shown in FIG. 11A, it should be noted that the conventional drilling tool has four equally spaced apertures 194, and thus there are four corresponding intake flows following corresponding intake flow paths 180.

Figure 11B:
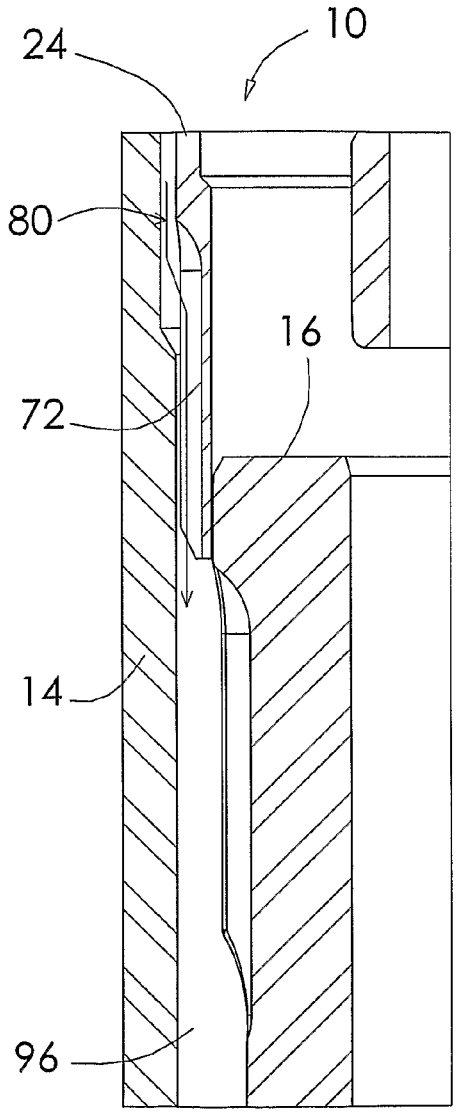

FIG. 11B is an enlarged view of a portion of the drilling tool 10 according to this application, taken from FIG. 8B. As seen in FIG. 11B, a comparable intake flow path 80 begins in the area of one of the grooves 72 formed in the backhead 24 and extends in a generally straight direction downward into a region 96 between the piston 16 and the wear sleeve 14.

The flow path 80 as shown in FIG. 11B, which corresponds to one of the grooves 72 appears as a single path. In fact, the flow path 80 comprises the area of all of the grooves 72 positioned around the entire circumference of the backhead 24. Thus, the many grooves 72 of the drilling tool 10 comprise a greater flow area than the four apertures 194 in the conventional drilling tool 10.

Because the flow path 80 is substantially free of sharp bends, loss of energy due to friction and decreases in velocity are reduced. Stated differently, the flow path 80 is much more energy efficient than the flow path 180 in the conventional drilling tool 110. In addition, the flow path 80 does not force the intake flow through any apertures or other bounded openings at sharp angles to the flow's primary direction. Also, the intake flow passes along walls (e.g., the outer periphery of the backhead 24) rather than through them (compare the conventional drilling tool 110, where the intake flow must pass through the inner cylinder 113).

Figure 12A:
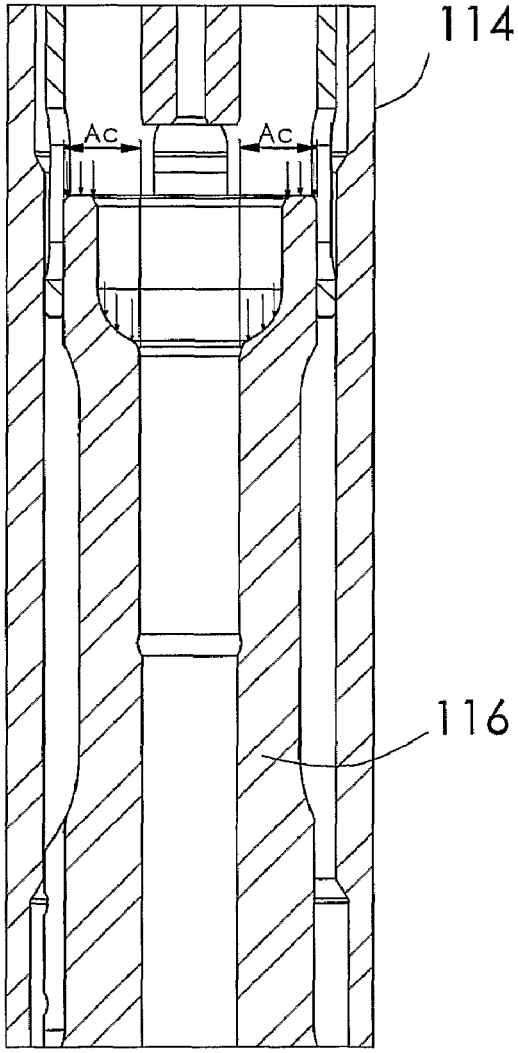
FIG. 12A PRIOR ART
FIG. 12A and FIG. 12B are enlarged views of portions of FIGS. 9A and 9B, respectively.
Figure 12B:
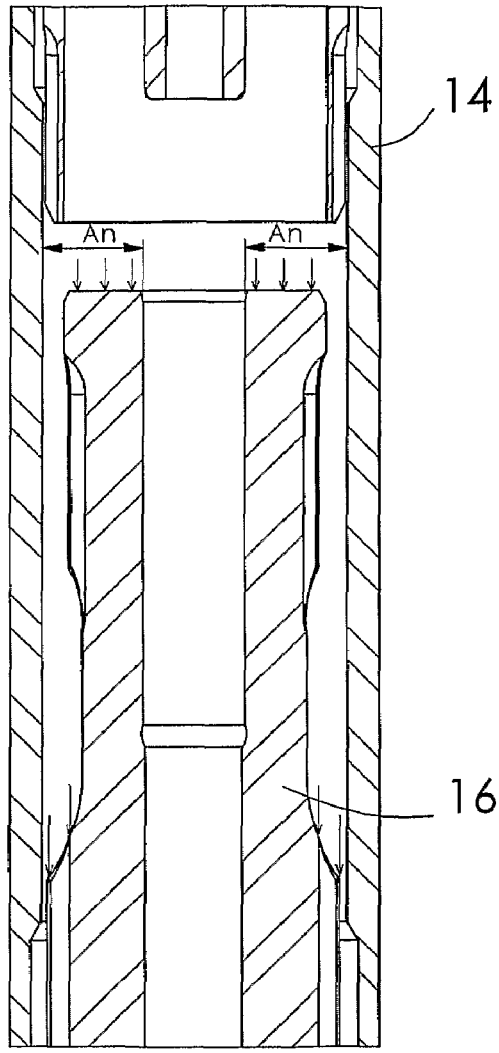

FIG. 12A is an enlarged section view of a portion of the conventional drilling tool 110 shown in FIG. 9A (drop open position). Similarly, FIG. 12B is an enlarged view of a portion of the drilling tool 10 according to this application, taken from FIG. 9B.

FIG. 12A shows the piston area, $A_C$, against which the pressurized operating fluid can act to move the piston 116 in the conventional drilling tool 110. As shown in FIG. 12B, the piston area $A_N$ in the drilling tool 10 is greater than the piston area $A_C$.

The available piston area includes the area of the upper surface of the piston and other areas exposed to the pressure, which equate to the annular area bounded on the outside by the piston's outer diameter and on the inside by the piston's axial bore. In some embodiments, the area $A_N$ exceeds the area $A_C$ by about 5% to even about 25%. As an example, a 4-inch diameter drilling tool may have a piston area $A_C$ of about 8.36 $in^2$, whereas a 4-inch diameter drilling tool according to an embodiment of this application has a piston area $A_N$ of about 9.13 $in^2$, which is about 9.3% greater.

The greater available piston area in the drilling tool 10 allows the pressure acting on the piston 16 to move the piston more quickly, thus increasing the power of the piston.

In the drilling tool 10, when bit is positioned in the drop open position, as best seen in FIG. 9B, the upper end of the piston is spaced away any surrounding surfaces. Because the entire circumferential area around the piston 16 is open, this area fills with pressurized fluid quickly and thus pushes the piston 16 downward to the full drop open position shown in FIG. 9B faster.

By way of contrast, in the drilling tool 110, the piston 116 remains in contact with the surrounding inner cylinder 113. Thus, pressurized air tending to push the piston 116 downward into the full drop open position shown in FIG. 9A must be forced through the smaller area of the four apertures 194.

In addition, as best seen by comparing FIG. 9A and FIG. 9B, because the drilling tool 10 is designed to function without the upper end of the piston 16 being in contact with any surrounding structure in the drop open position, the piston 16 can be made shorter in length than the piston 116 of the conventional drilling tool 110 of a comparable overall outer diameter.

Figure 13A:
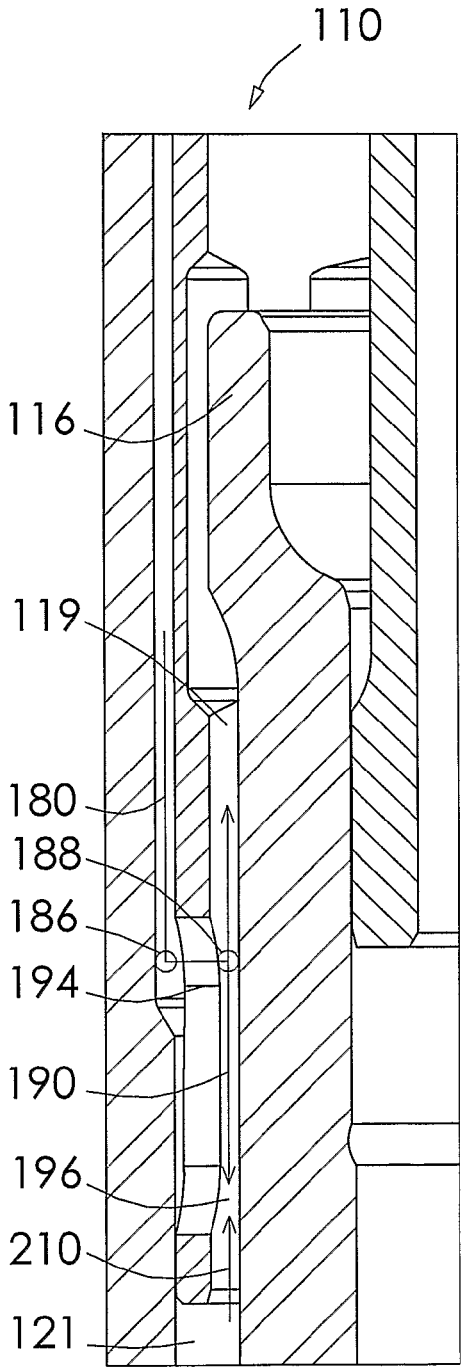
FIG. 13A PRIOR ART
FIG. 13A and FIG. 13B are enlarged views of portions of FIG. 10A and FIG. 10B, respectively.

FIG. 13A is an enlarged section view of a portion of the conventional drilling tool 110 shown in FIG. 10A, where the piston 116 is in its uppermost position and just prior to commencing a downward stroke. As shown in FIG. 13A, the intake flow follows the same flow path 180 that includes the two sharp bends 186, 188 as shown and as described above in connection with FIG. 11A.

In addition, as the intake flow travels through the aperture 194 and then flows in a downward direction along the lower segment 190 within the inner passageway 196, it encounters a volume of pressurized air in an area 121 (FIG. 10A) surrounding the piston 116. At the position shown in FIG. 13A, the piston 116 has just moved upward (i.e., from the position shown in FIG. 11A) such that its upper end is no longer sealed against the inner cylinder 113, thereby creating an upper opening 119 (i.e., the space between the outer surface of the piston and the inner relieved surface of the inner cylinder 113, which has a larger diameter) in the passageway 196. The opening 119 thus connects the lower portion of the passageway 196 with the space above the upper surface of the piston 116, which is at a lower pressure. Once the opening 119 is established, the higher pressure fluid in the area 121 seeks to expand, thus exerting an upward pressure in the direction of the opening 119. At the same time, however, a portion of the intake flow from the aperture 194 is seeking to flow downwardly through the passageway 196 (a portion of the intake flow also flows upwardly as shown). Thus, the intake flow, particularly along the lower segment 190, must overcome the oppositely directed pressure 210 from the area 121. As shown by the arrows, this confrontation takes place in a highly constricted area. Because of this confrontation, the intake flow along the intake flow path 180 experiences greater energy losses and its resulting velocity is lower.

Figure 13B:
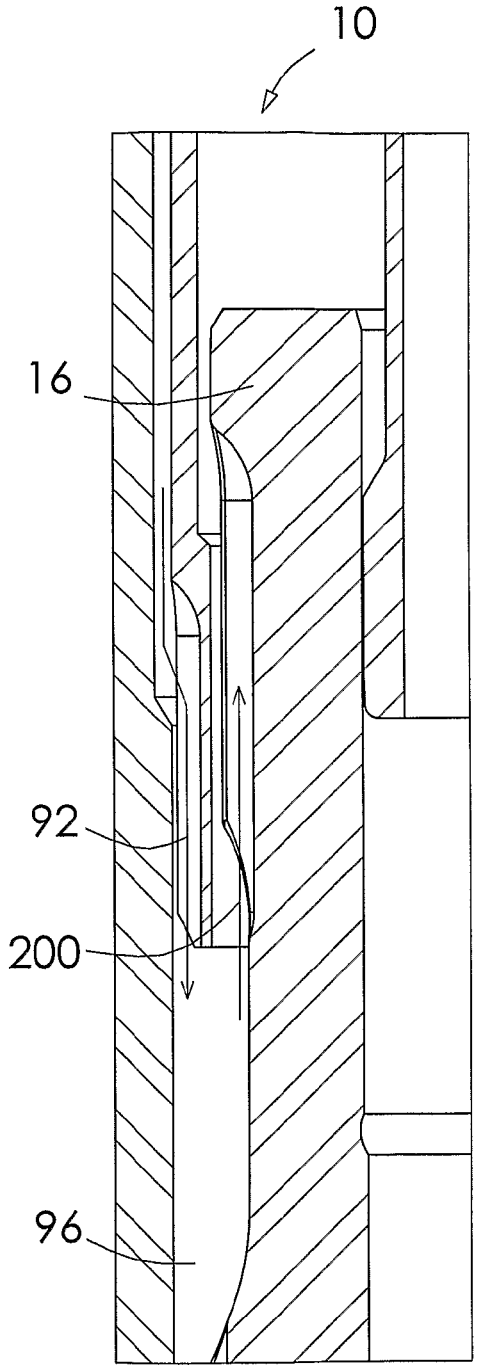

FIG. 13B is an enlarged section view of a portion of the drilling tool 10 according to this application, taken from FIG.

10A. In contrast to the conventional drilling tool 110, the intake flow path 92 and the filling flow path 200 are arranged for increased efficiency. First, the number of sharp bends in the intake flow path is reduced (in the case of the flow path 92, there are no sharp bends). Second, the intake flow path 92 and the filling flow path 200 are configured so that they are spaced apart from each other rather than directed along nearly the same axis. Third, the area where the intake flow and the filling flow first encounter each other (i.e., where they are first no longer separated from each other by a wall), has a much larger cross section to promote separation between the flows.

Comparing FIG. 13B to FIG. 13A, it can be seen that the cross-sectional area of the inner passage way 96 in the area where the flows 92 and 200 pass each other is much greater than the area of the inner passageway 196 adjacent the aperture 194. In addition, as described above, there only four such flow path areas as shown in FIG. 13A, whereas there are a much greater number of the flow paths shown in FIG. 13B. Therefore, compared to the conventional drilling tool, the flow 92 in the drilling tool 10 flows with much less energy loss due to conflict with the flow 200, and vice versa.

In view of the many possible embodiments to which the principles of the disclosed invention may be applied, it should be recognized that the illustrated embodiments are only preferred examples and should not be taken as limiting in scope. Rather, the scope is defined by the following claims.

I claim:

1. A portion of a drill assembly operated by a supply of compressed fluid, comprising:

a backhead having a proximal end connectible to the supply, an axial bore and an open distal end having defined therein an integrated cylinder portion, the backhead having passages extending between the axial bore and outer surface of the backhead;

a hollow elongate wear sleeve having a proximal end to which the backhead is coupled and into which the distal end of the backhead is received; and a piston housed by the wear sleeve and having a proximal end shaped to fit within the integrated cylinder portion of the backhead, the piston being slidably movable along the wear sleeve and the integrated cylinder portion in response to compressed fluid conveyed through the backhead, wherein an intake flow path for an intake flow of compressed fluid in the drilling tool extends in a distal direction from the axial bore, through the passages in the backhead, through a space between the backhead and the wear sleeve and into an area between the piston and wear sleeve and into contact with the piston, and wherein the intake flow path is free from sharp bends.

2. The drill assembly of claim 1, wherein the intake flow path does not extend through any apertures forcing the intake flow in a radially inward direction.

3. The drill assembly of claim 1, wherein the intake flow path does not require the intake flow to pass inwardly through any openings defined in a sidewall of the backhead.

4. The drill assembly of claim 1, further comprising a distributor positioned at least partially within the axial bore between the proximal end and the distal end, the distributor being removably secured to the backhead by a securing member accessible from an exterior surface of the backhead, the distributor including a check valve that is opened to allow the intake flow from the supply.

5. The drill assembly of claim 1, further comprising a chuck coupled to a distal end of the wear sleeve and capable of receiving a drill bit and being movable in response to contact from the piston.

6. A portion of a drill assembly operated by a supply of compressed fluid, comprising:

a backhead having a proximal end connectible to the supply, an axial bore and an open distal end having defined therein an integrated cylinder portion, the backhead having passages extending between the axial bore and outer surface of the backhead;

a hollow elongate wear sleeve having a proximal end to which the backhead is coupled and into which the distal end of the backhead is received;

a piston housed by the wear sleeve and having a proximal end shaped to fit within the integrated cylinder portion of the backhead, the piston being slidably movable along the wear sleeve and the integrated cylinder portion in response to compressed fluid conveyed through the backhead;

wherein when the drill assembly is in a drop open position, the proximal end of the piston is spaced apart from the integrated cylinder portion in the distal direction and an open annular space is defined between the proximal end of the piston and the wear sleeve.

7. The portion of the drill assembly according to claim 6, wherein the piston has an available piston area subject to pressure tending to move the piston in a distal direction that is about 5 % to about 25 % greater than the available piston area of a conventional drill assembly of the same outer diameter.

8. The portion of the drill assembly of according to claim 7, wherein the piston has an available piston area subject to pressure tending to move the piston in a distal direction that is about 8 % to about 10 % greater than the available piston area of a conventional drill assembly of the same outer diameter.

9. The portion of the drill assembly of according to claim 7, wherein the piston has an available piston area subject to pressure tending to move the piston in a distal direction that is at least about 9 % greater than the available piston area of a conventional drill assembly of the same outer diameter.

10. A portion of a drill assembly operated by a supply of compressed fluid, comprising:

a backhead having a proximal end connectible to the supply, an axial bore and an open distal end having defined therein an integrated cylinder portion, the backhead having passages extending between the axial bore and outer surface of the backhead;

a hollow elongate wear sleeve having a proximal end to which the backhead is coupled and into which the distal end of the backhead is received; and a piston housed by the wear sleeve and having a proximal end shaped to fit within the integrated cylinder portion of the backhead, the piston being slidably movable along the wear sleeve and the integrated cylinder portion in response to compressed fluid conveyed through the backhead, wherein an intake flow path for an intake flow of compressed fluid in the drilling tool extends in a distal direction from the axial bore, through the passages in the backhead, through a space between the backhead and the wear sleeve and into an area between the piston and wear sleeve and into contact with the piston, and wherein a filling flow path extends in the proximal direction from the area between the piston and the wear sleeve, along the piston and between the piston and the backhead into a space proximal of the proximal end of the piston, and wherein a separation is maintained between the intake flow path and the filling flow path in the area between the piston and the wear sleeve.

11. The portion of the drill assembly of claim 10, wherein the distal end of the backhead has a circumferential wall configured to guide the filling flow flowing in the proximal direction along an inner surface of the wall and configured to guide the intake flow flowing in the distal direction along an outer surface of the wall, the intake flow and the filling flow being separated from each other by the wall.

* * * * *